United States Patent [19]

Johnson

[11] 4,437,706

[45] Mar. 20, 1984

[54] HYDRAULIC MINING OF TAR SANDS WITH SUBMERGED JET EROSION

[75] Inventor: Herbert S. Johnson, Oakville, Canada

[73] Assignee: Gulf Canada Limited, Toronto, Canada

[21] Appl. No.: 289,333

[22] Filed: Aug. 3, 1981

[51] Int. Cl.[3] ..... E21C 41/10

[52] U.S. Cl. ..... 299/7; 299/17

[58] Field of Search ..... 299/2, 4, 5, 17; 175/67, 422, 66, 206

[56] References Cited

U.S. PATENT DOCUMENTS

| | | | |
|---|---|---|---|
| Re. 29,021 | 11/1976 | Archibald et al. | 175/213 |
| 1,607,586 | 11/1926 | Claytor | 299/17 X |
| 1,612,611 | 12/1926 | Clayton | 299/17 X |
| 1,851,565 | 3/1932 | Claytor | 299/17 |
| 3,070,361 | 12/1962 | Pew | 299/17 |
| 3,393,013 | 7/1968 | Hammer et al. | 299/17 |
| 3,874,733 | 4/1975 | Poundstone et al. | 299/17 |
| 3,934,935 | 1/1976 | Lambly et al. | 299/2 |
| 3,951,457 | 1/1976 | Redford | 299/5 |
| 3,957,308 | 5/1976 | Lambly et al. | 299/17 X |
| 3,958,641 | 5/1976 | Dill et al. | 299/17 X |
| 4,109,715 | 8/1978 | Adamson | 299/17 X |
| 4,167,290 | 9/1979 | Yamazaki et al. | 299/1 |

FOREIGN PATENT DOCUMENTS

| | | |
|---|---|---|
| 454651 | 6/1949 | Canada . |
| 832827 | 1/1970 | Canada . |
| 833331 | 2/1970 | Canada . |
| 989729 | 5/1976 | Canada . |
| 1018556 | 10/1977 | Canada . |
| 1034867 | 7/1978 | Canada . |

*Primary Examiner*—Ernest R. Purser
*Attorney, Agent, or Firm*—R. H. Saunders

[57] ABSTRACT

Bitumen is separated and recovered from tar sands deposits by use of special hydraulic mining techniques. One or more jets of hydraulic mining fluid are projected by a nozzle or nozzles against a face of a tar sands deposit and advanced towards the face as the face erodes under the jetting action. Sand and bitumen separate, due to the jetting action, and are removed from the eroding area by the flow of hydraulic fluid which is cycled to a recovery zone for separation of fluid, sand, and bitumen. Fluid is recycled, bitumen recovered, and sand disposed of as backfill. Advance of a single nozzle is varied by lateral diversion to erode over a wider area of the face and increase the volume eroded by a single advancing jet.

22 Claims, 5 Drawing Figures

FIG. 4
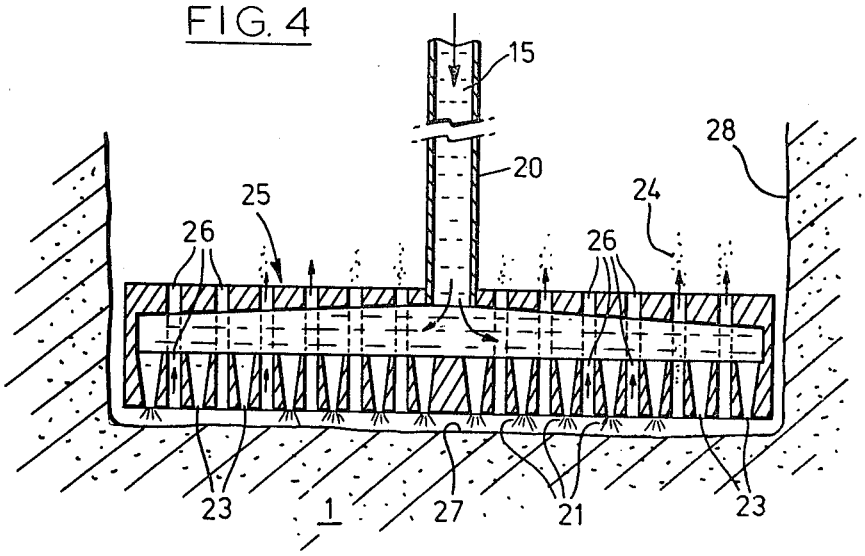
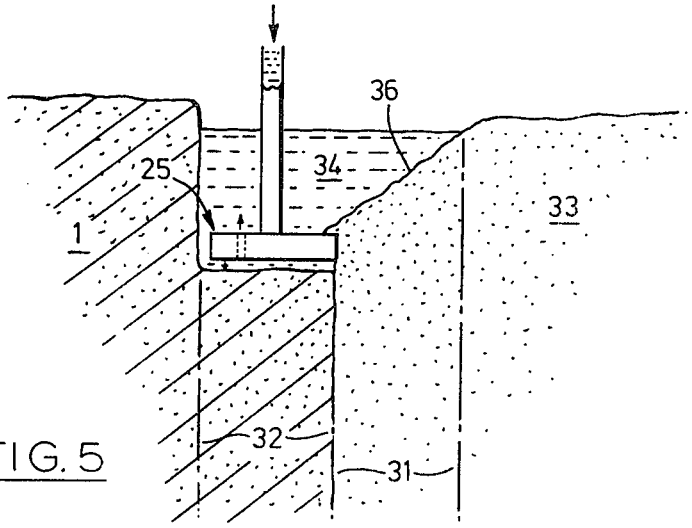
FIG. 5

HYDRAULIC MINING OF TAR SANDS WITH SUBMERGED JET EROSION

This invention relates to a method for recovering bitumen from unconsolidated bitumen-bearing formations including tar sands by hydraulic mining.

Petroleum is found in underground deposits or reservoirs from which it can in many cases be recovered by allowing it to flow to wells drilled into the reservoir, whence it can be pumped to the surface. Some reservoirs contain petroleum which is too viscous to flow toward the wells at an economic rate. These include the types known as heavy oils. Other reservoirs, on the other hand, contain petroleum that will not flow at all at ambient temperatures, including the petroleum found in the Athabasca tar sands in Alberta, Canada. This type of petroleum is known as bitumen, and a number of techniques have been developed in attempts to recover it economically. The only methods used in commercial operations to date are surface mining methods, wherein the overburden is removed and the tar sands broken up by mechanical action into pieces capable of being put through an extraction process using hot water to separate the bitumen from the other materials in the tar sands. Surface mining is limited to areas where the overburden is thin enough that it can be economically removed, putting about 90% of the bitumen contained in the tar sands out of economic reach. Where the overburden is too thick for economic removal, in-situ methods are used, in which wells are sunk from the surface to reach the zone containing the bitumen in combination with sand, clay or other minerals. In the well-known steam stimulation process, a combination injection/production well is drilled, and steam is injected into the reservoir in order to reduce the viscosity and increase the flowability of the bitumen, which can then be pumped out. A modification called the steam drive process uses separate injection and production wells and the flow of steam assists the flow of bitumen by creating a pressure gradient as well as reducing its viscosity. Both processes are extravagant in their use of energy, requiring about 12 gigajoules of energy input to recover one cubic meter of bitumen with a heating value of about 42 gigajoules.

Hydraulic mining methods have been proposed to overcome the necessity of removing the overburden. Several proposals have involved the driving of tunnels beneath the reservoir. An early invention was that of Laughlin, U.S. Pat. No. 1,936,643 (1933), which disclosed the projection of hot water upwardly through fixed pipes spaced at intervals along a tunnel. The tar sand was loosened and allowed to fall into the tunnel whence it was removed to a separation plant. Lambly et al, U.S. Pat. No. 3,934,935, disclosed a method using jets to loosen and create a slurry of tar sand which flowed downwardly and was removed to a separation plant through pipes placed in tunnels underlying the reservoir. The invention of Redford, U.S. Pat. No. 3,951,457, was a method operable from the surface. Redford disclosed a technique using an injection string equipped with a drill bit at its lower end and having horizontal jet streams directed at the tar sand deposit. The jets could be rotated with the injection string, loosening the deposit which was pumped as a slurry to the surface where the bitumen separated from the sand and water in a settling tank. A non-condensable gas was injected to provide a gas-filled cavity so that the jets reached deeply into the cavity.

In any technique not providing a gravity drain for produced slurry, unless gas pressure is provided to depress the liquid below the path of a jet, there still remains the problem that the effectiveness of the jet extends only a short distance from the nozzle. This problem is overcome by the present invention which provides a movable jet. Accordingly, the invention consists in a method of recovering bitumen from unconsolidated bitumen-bearing formations including tar sands, comprising:

(a) introducing into said formation at least one nozzle projecting a jet of aqueous hydraulic mining fluid at high velocity towards said formation, said jet having a forward component;

(b) bringing said nozzle into proximity with said formation, said jet impinging thereon with sufficient velocity to erode said formation and substantially separate said bitumen from other components thereof;

(c) advancing said nozzle towards said formation as it erodes to separate further quantities of bitumen; and (d) recovering said separated bitumen.

The invention further consists in an apparatus for recovering bitumen from unconsolidated bitumen-bearing formations, comprising:

(a) at least one nozzle, adapted to discharge a jet of hydraulic mining fluid towards an erodable face of said formation, thereby separating said formation into a bitumen-rich material and a sand-rich material;

(b) means adapted to move said nozzle towards said face as it erodes: and (c) recovery means adapted to recover said bitumen-rich material separately from said sand-rich material.

In the present invention, the jet provides rapid erosion of the formation without the need for removing the mining fluid from the jet's path by being advanced continually towards the eroding face of the formation. The jet can be placed on rigid or flexible tubing, or tubing comprising both rigid and flexible sections. A single jet can be employed, producing a relatively narrow borehole if it is advanced in a linear path, or producing a wide cavity it it is allowed to sweep from side to side across the axis of the rigid part of the tubing. The jet can point an axial direction relative to the tubing, or it can discharge at an angle to the tubing axis; such angle can range up to about ninety degrees. A plurality of jets can be employed, spaced so as to complement one another, acting in a single direction or in more than one direction. It is necessary that there be some forward component to the jet to aid in its forward penetration of the formation, because a jet with no forward component erodes a wide but not deep hole. The forward component can advantageously comprise at least one jet having a forward angle, or it can comprise a plurality of jets, at least one of which projects with a forward component and at least one projects laterally. The jet impinges on the face of the bitumen-bearing formation with a velocity high enough to erode the formation and to separate a bitumen-rich material from the sand which makes up the bulk of the formation, and as the face moves away from the jet because of erosion, the jet is advanced continuously or stepwise towards the face, continuing the erosion and separation.

The hydraulic mining fluid can be water with no additives. It can be cold water, but is preferably at least at the same temperature as the formation and most preferably is at least 60° C. for best separation of the bitumen-rich material from the sand. Any gases naturally dissolved in the mining fluid tend to release with the release of pressure at the nozzle, and to aid in flotation of the bitumen. Optionally, additional gas can be dissolved in the mining fluid to increase the flotation effect. The density of the mining fluid can optionally be increased to aid in floating the bitumen by dissolving one or more solids in it, preferably inorganic salts, for example sodium chloride, which is inexpensive and readily available, and which can raise the density of an aqueous mining fluid sufficiently to float any known bitumen. Optionally, the mining fluid can include a surfactant to aid in separation of clays that may be entrained in the bitumen.

The several configurations of nozzle and flexible or rigid, straight or curved tubing can be used in various combinations sequentially on the same borehole. For example, it may be desirable to switch from a rigid to a flexible tubing during the mining of a cavity.

The invention will now be further described by way of example only and with reference to the drawings in which:

FIG. 4 illustrates a surface mining operation incorporating a multiple-jet device allowing an increased production rate of bitumen-containing slurry; and FIG. 5 illustrates an elevation of a surface mining operation using the multiple-jet device.

Figure 1:
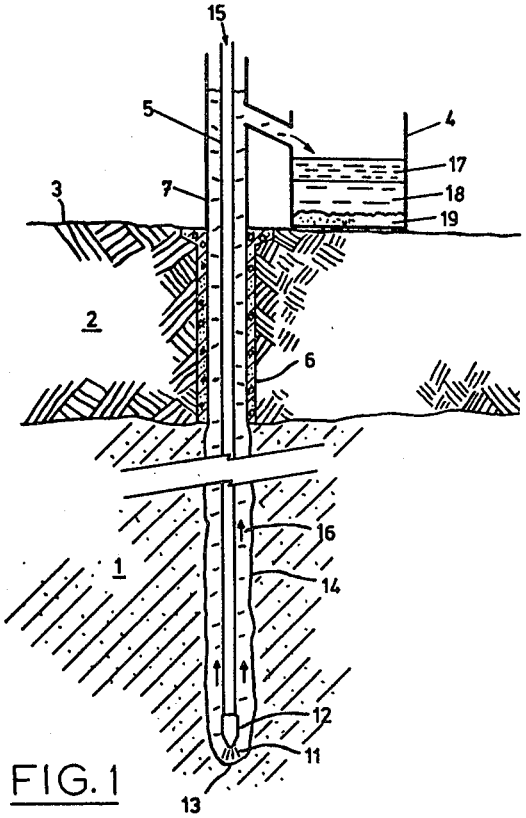
FIG. 1 shows a preferred embodiment of the invention, in which a single jet nozzle moves in a single axis in an in-situ operation.

In FIG. 1, there is illustrated a travelling jet which dislodges the matrix in which the bitumen is trapped. The surface being attacked continually breaks away and as it does so the jet is advanced towards the eroding face, breaking away more of the matrix and continuing until the extremity of the pay zone is reached. Hydraulic mining fluid 15 is introduced into tubing 5 under pressure and issues through nozzle 12 as jet 11. The overburden 2 can be drilled if desired, or optionally it can be bored using the hydraulic jet itself. When the overburden 2 has been penetrated a casing 6 can be set, in order to minimize the erosion of material from the overburden layer as produced slurry 16, comprising bitumen, sand, and water, passes by on its way to the surface. The casing need not be taken below the overburden 2 because any enlargement of annular space 14 in bitumen-containing zone 1 would be advantageous as it would produce bitumen, provided the enlargement was not so great as to cause collapse of the overburden. As jet 11 begins to erode face 13 of the bitumen-containing zone 1 directly in front of it, new surface is exposed farther away from jet 11. As is well known in the art, the force of a submerged jet of liquid decreases rapidly with increasing distance from the nozzle; therefore the rate of erosion of face 13 rapidly falls off if nozzle-to-face distance increases. Tubing 5 is relatively long and permits nozzle 12 to be advanced in order to remain close to face 13 as face 13 is eroded by the action of jet 11, moving as far as the extremity of bitumen-containing zone 1, all the while maintaining pressure of the hydraulic mining fluid. Any suitable equipment may be used for advancing the tubing and feeding fluid. Preferred devices are of the general class termed "reeled-tubing units", which are commonly used for oil well maintenance work, and which use tubing that is effectively rigid and straight when off the reel. It is generally convenient to advance nozzle 12 at a rate as high as the maximum rate of erosion of face 13 will allow. The produced materials in slurry are carried upwards in the annular space 14, emerging above ground surface 3 in aboveground casing 7 from which they flow into settling zone 4, where the materials settle in order of density. Where the hydraulic mining fluid is of intermediate density, the sand 19 settles to the bottom of settling zone 4, hydraulic mining fluid layer 18 is intermediate and bitumen layer 17 rises to the top. The high degree of separation obtained is due to the action of jet 11 at face 13, which not only loosens small pieces of bitumen-sand matrix but also frees the bitumen from most of the associated sand particles that make up the larger part of the matrix. The sand that is separated constitutes the bulk of the material in the bitumen-containing zone and when it is removed, the bitumen is in condition for further processing. The separated sand can be replaced in the excavation by suitable means, thereby minimizing the disposal problem.

Figure 2:
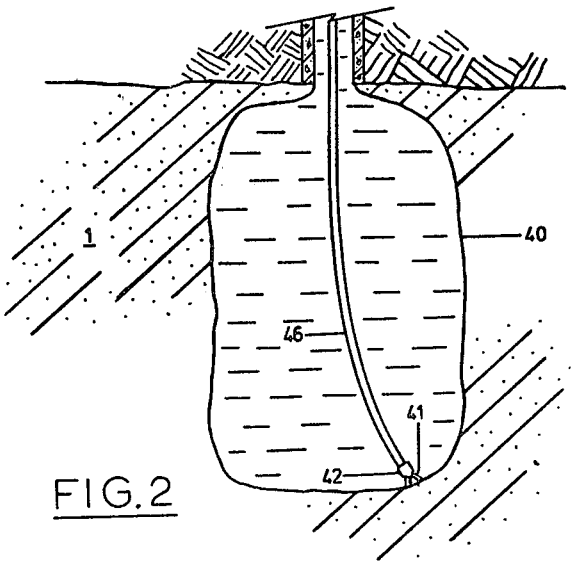
FIG. 2 shows a variation of the embodiment of FIG. 1 wherein the nozzle moves in more than one axis.

In FIG. 2, another embodiment of the invention is illustrated in which a large cavity is created in the formation by the action of jet 41. This is accomplished by providing the jet 41 with a lateral force component by drilling nozzle 42 slightly off-axis relative to tube 5, or by imposing a small curvature 46 on the leading section of tube 5 or by other suitable means. Nozzle 42 advances along the path cleared by jet 41 and, in the absence of any rotary motion of the tube, describes an arc representing the circumference of a circle in a vertical plane with a radius determined by the relative magnitudes of the axial and off-axis force components. This radius must be large enough so that a tubing possessing sufficient flexibility will impose no significant frictional force on the slightly curved hole boundary.

After a relatively short advance in a generally downward, but slightly curved path, the advance is reversed and a rotary, or a limited oscillatory, motion is imposed on the tubing at the surface by means known in the art. Tubing 5 is then advanced and Jet 41 thus sweeps a wider conical space instead of the narrow cylindrical volume of the embodiment shown in FIG. 1. The sequence is repeated so as to enlarge the conical space. As the cavity increases in size, the tubing is subject to reaction forces tending to drive it across the diameter of the cavity so that the central portion is also cleared. This motion can be further controlled by cyclical changes of jet pressure between an upper and lower limits. By repeated rotations of the tubing as the face erodes, bitumen can be produced from a large cavity 40 in bitumen-bearing zone 1.

Figure 3:
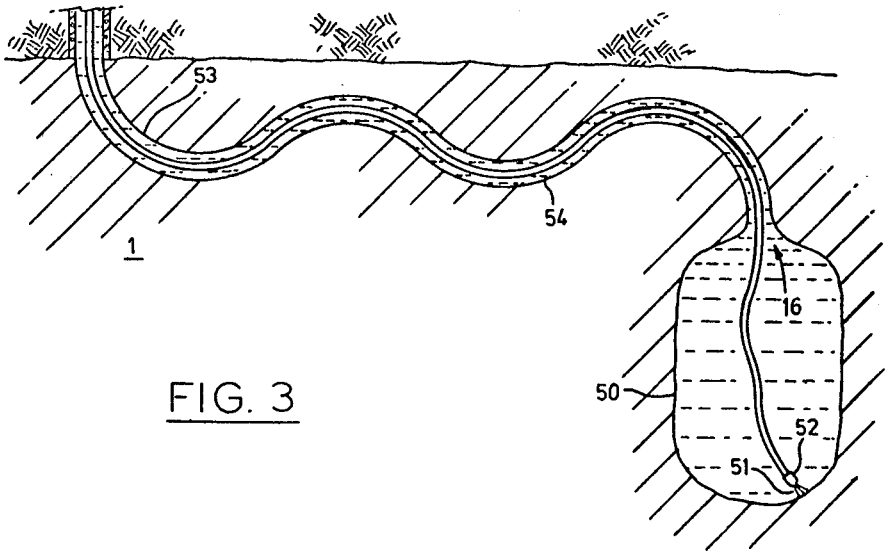
FIG. 3 illustrates a variation of the embodiment of FIG. 2 which can bore an essentially horizontal passage and open a cavity remote from the wellhead.

FIG. 3 shows an adaptation of the embodiment shown in FIG. 2 which is controllable and capable of drilling a hole in a generally horizontal direction. As described in relation to FIG. 2, an off-axis force component in jet 51 causes the nozzle 52 to follow a circular arc in the absence of an imposed rotation. With an imposed rotation, or controlled oscillation, the nozzle advances along a generally helical path 53, 54 to a chosen position in the formation. In this location, a cavity 50 can be formed in the bitumen-bearing zone 1 by the same process as described in relation to FIG. 2.

In a large cavity most of the sand remains in the cavity because the upward velocity of the returning fluid 16 is below the critical fluidization velocity of the sand particles. At the end of the production operation, a tube or hose can be substituted for the jet device and a sand slurry pumped from the reclaim area at the surface to the cavity until returning sand at the surface signals that the cavity has been filled to capacity with sand. Optionally, several cavities can be eroded and the bitumen produced, using a single well.

FIG. 4 illustrates an embodiment of the invention in a surface mining operation on a large scale. Jet plate assembly 25 includes a plurality of nozzles 23 facing downwards which are supplied with hydraulic mining fluid 15 through supply pipe 20. Jets 21 issue from nozzles 23 eroding face 27 of the bitumen-containing zone 1 in an area approximately as large as the area attached by the jets. The nozzles are disposed over the underside of the jet plate assembly in such a manner that the area eroded by each jet is contiguous with or slightly overlaps the area eroded by the adjacent jet at the selected conditions of hydraulic mining fluid density and pressure, and of jet geometry. The nozzles can conveniently be arrayed in a square arrangement, that is, an arrangement wherein each nozzle is equidistant from its four nearest neighbours and wherein a line drawn through two of its nearest neighbours and itself is perpendicular to a line drawn through the other two of its nearest neighbours and itself. A square arrangement is preferred where the nozzles have a square spray pattern. In cases where round-pattern nozzles are used it is preferable to set up the nozzle array in a hexagonal arrangement, i.e. in an array in which each nozzle is equidistant from its six nearest neighbours, thus providing complete spray coverage with minimum overlap. Optionally, the jets can include a lateral component in their spray patterns. The plate assembly 25 can optionally be rotationally moved in a lateral plane to move the nozzles past the eroding surface, providing a uniform spray coverage. The hydraulic mining fluid pressure in the supply pipe 20 can be varied to suit the conditions. Within limits, the spray pressure required to dislodge and separate the sand from the bitumen is proportional to the forces binding the two components. Higher pressure requires greater energy to drive the hydraulic mining fluid. As noted above, it is known that the effectiveness of submerged hydraulic jets falls off rapidly with increasing distance from jet to eroding face; the rate of advancement of the jet plate assembly is adjusted so that the rate of erosion of the face equals the rate of advance. The jet plate assembly is rigidly supported in order to control its horizontal and vertical position during lowering and raising of the assembly.

Produced slurry 24 containing bitumen, sand and hydraulic mining fluid passes through plate 25 via return holes 26; the return holes 26 pass upwards through plate 25 adjacent to, but not in contact with, the plenum supplying nozzles 23.

In a field production operation, an embodiment having a jet plate assembly can be used as shown in FIG. 5. It is advantageous to remove the overburden prior to starting the operation. A travelling lake is depicted wherein the jet plate assembly 25 is advanced to a level no lower than the depth of the bitumen-containing zone 1 in successive channels. After the jets erode and produce the bitumen and sand in one channel 31, the jet plate assembly is raised and moved approximately the amount of its width, then advanced into adjacent channel 32. The plate assembly can be advanced in a direction either vertical or at an angle to the vertical, the selection of angle being related to, inter alia, the conditions at the mining site. Produced sand separates from bitumen and returns to the pay zone as sand fill 33. The sand is carried in a generally upward direction by the rising water. Directly above the plate the sand is in a fluidized condition. Outside the fluidized region the sand can settle to form inclined sand surface 36. The height of the pile of returned sand 33 can be varied by a mechanical device to suit the needs of the operation of jet plate assembly 25. Produced material 34 comprises bitumen in a top layer, hydraulic mining fluid in an intermediate layer, and sand in a bottom layer, providing the density of the hydraulic mining fluid is between that of the bitumen and that of the sand. The produced sand usually occupies a greater volume than the same mass of sand in the undisturbed state, and there may thus be a small surplus of sand to be disposed of at the surface after the underground space occupied by the bitumen-containing sand is refilled with produced sand. If there is no overburden at the site, all of the produced sand can be moved by a suitable device and replaced, raising the level of the surface slightly until settling occurs.

EXAMPLE

The following example is illustrative of the process and is not intended to restrict the scope of the invention.

A sample of mined tar sands material taken from the Surmont deposit in Alberta was packed into a test cell to simulate in-situ conditions. The 120 ml capacity vessel was a pressure gauge sight glass comprising a steel frame, two of whose sides were of heavy glass material permitting viewing of the contents. The top of the test cell was fitted with a small vertical containment tube from the side of which led a downwardly sloping conduit. A catch vessel at the bottom of the conduit trapped the material produced from the test cell. A water storage vessel contained a supply of water kept at an appropriate temperature, and was equipped with a thermocouple, auxiliary heater, and a sealed top capable of containing a controlled pressure sufficiently high to produce a jetting action from a 1.6 mm outside diameter stainless steel tube 40 cm long, connected to the bottom of the storage vessel by flexible pressure tubing through a shut-off valve. With water heated to 80° C. under a nitrogen pressure of 3.55 MPa (absolute) and moderate downward manual force, the tube penetrated to the bottom of the tar sand pack in approximately two seconds with very little resistance, travelling a distance of about 30 cm downwards. A slurry of injected water and tar sand overflowed into the catch vessel; the slurry immediately separated into three layers: sand, cloudy water and bitumen-rich material. From the cloudy water layer a slowly-settling material gradually separated, leaving a relatively clear water layer. The relative amounts were sand, 10 ml; slowly-settling material, 8 ml; water, 100 ml; and bitumen-rich layer, 10 ml.

The present process is useful in the recovery of oil sands bitumen. It is capable of easily separating bitumen from sand in oil sands that are susceptible to the hot water process. Further, it is clear that the jet action causes the separation at the surface being attacked, thus making it feasible to leave a substantial portion of the sand underground and produce mainly the water and bitumen. Even if sand is produced, an important advantage is that substantially all of it can be reinjected into the well after completion, thus minimizing the disposal problem. Another advantage of the present invention is that the advancing jet erodes the surface of the reservoir without the necessity to surround the jet with a gaseous medium. A further advantage of the present invention over steam processes is its relatively high energy efficiency. Because the maximum temperature to which the reservoir is heated is only about 100° C., compared to up to 300° C. using steam, the thermal losses are much lower. Combined with the energy required for pumping, the present process uses about one-eighth to one-fifth the energy required for steam processes.

An advantage of aqueous hydraulic mining fluid over hydrocarbon solvents is that any of the fluid that evaporates or escapes from the system does not cause environmental damage. Any makeup fluid that is added to compensate for losses costs much less than hydrocarbon solvents; in addition, the volume lost to evaporation is lower than that of volatile solvents. Because water does not dissolve substantial quantities of bitumen, the mining fluid can easily be separated for recycling.

What is claimed is:

1. A method of recovering bitumen from unconsolidated bitumen-bearing formations including tar sands, comprising:

(a) introducing into said formation at least one nozzle projecting at least one jet of aqueous hydraulic mining fluid at high velocity through a liquid medium towards said formation, said jet having a forward component;

(b) bringing said nozzle into proximity with said formation, said jet impinging thereon with sufficient velocity to erode said formation and substantially separate said bitumen from other constituents of said formation;

(c) advancing said nozzle towards said formation as it erodes to separate further quantities of bitumen; and (d) recovering said separated bitumen.

2. A method as claimed in claim 1, wherein a plurality of nozzles is simultaneously brought into proximity with and advanced towards said formation.

3. A method as claimed in claims 1 or 2, wherein said bitumen-bearing formation is tar sand.

4. A method as claimed in claim 1, wherein said nozzle is attached to a tubing of sufficient flexibility to allow the end of said tubing to which said nozzle is attached to describe an arcuate motion when said fluid is issuing under pressure from said jet, and to cause said jet to erode said formation over an arcuate area.

5. A method as claimed in claim 4, wherein said tubing is rotated simultaneously as said nozzle erodes said formation over an arcuate area, whereby a cavity is created whose diameter is large in comparison to the diameter of said nozzle.

6. A method as claimed in claim 4, wherein said tubing comprises a rigidly curved portion adjacent said nozzle, further comprising the steps of:

(a) withdrawing said nozzle from said eroding face;

(b) rotating said tubing and nozzle; and (c) advancing said nozzle towards a second portion of said eroding face, said steps being carried out repeatedly and in sequence to create a substantially conical cavity.

7. A method as claimed in claim 6, wherein said tubing is simultaneously advanced and rotated, whereby said nozzle advances in a substantially helical path.

8. A method as claimed in claim 7, wherein said tubing is simultaneously advanced and rotated through a defined angle, and said tubing is further simultaneously advanced and rotated back through a substantially equal angle, causing said nozzle to advance in a substantially predictable direction.

9. A method as claimed in claim 1, wherein said fluid comprises water.

10. A method as claimed in claim 9, wherein the temperature of said water is at least equal to the formation temperature.

11. A method as claimed in claim 9, wherein the temperature of said water is at least 60° C.

12. A method as claimed in claim 9, wherein said fluid comprises water and at least one dissolved solid which raises the density of said fluid.

13. A method as claimed in claim 12, wherein said dissolved solid comprises an inorganic salt.

14. A method as claimed in claim 12, wherein said dissolved solid comprises sodium chloride.

15. A method as claimed in claim 9, wherein said fluid comprises water and a surface active agent.

16. A method as claimed in claim 9, wherein said fluid further comprises a dissolved gas.

17. Apparatus for recovering bitumen from unconsolidated bitumen-bearing formations, comprising:

(a) at least one nozzle, adapted to discharge a jet of hydraulic mining fluid through a liquid medium towards an erodable face of said formation, said jet being of sufficient velocity to separate eroding formation material into a bitumen-rich material and a sand-rich material;

(b) means adapted to move said nozzle towards said face as it erodes; and (c) recovery means adapted to recover said bitumen-rich material separately from said sand-rich material.

18. Apparatus as claimed in claim 17, wherein said means to move said nozzle comprises tubing adapted to carry said hydraulic mining fluid.

19. Apparatus as claimed in claim 17, wherein said means to move said nozzle permits said nozzle to sweep laterally as well as to move axially towards said eroding face.

20. Apparatus as claimed in claims 18 or 19, wherein said means to move said nozzle comprises flexible tubing.

21. Apparatus as claimed in claim 1, wherein said jets discharge substantially parallel to each other.

22. Apparatus as claimed in claim 17, comprising a plurality of nozzles, said nozzles being rigidly mounted in a plane.

* * * * *